United States Patent [19]

Bauer

[11] Patent Number: 4,508,290

[45] Date of Patent: Apr. 2, 1985

[54] CAP ASSEMBLY WITH FRICTION DRAG ON TENSION BRUSH

[75] Inventor: Gordon L. Bauer, Shelton, Conn.

[73] Assignee: Wyrepak Industries, Inc., Bridgeport, Conn.

[21] Appl. No.: 577,440

[22] Filed: Feb. 6, 1984

[51] Int. Cl.[3] ..... B65H 49/00; B65H 59/00

[52] U.S. Cl. ..... 242/128; 242/147 R

[58] Field of Search ..... 242/128, 147 R, 156, 242/156.2; 403/359; 188/71.4

[56] References Cited

U.S. PATENT DOCUMENTS

| | | | |
|---|---|---|---|
| 3,106,990 | 10/1963 | Kershner | 188/71.4 |
| 3,624,717 | 11/1971 | Brubaker | 403/359 |
| 3,972,489 | 8/1976 | Kovaleski | 242/128 |
| 4,062,505 | 12/1977 | Kovaleski | 242/128 |
| 4,298,174 | 11/1981 | Kovaleski | 242/128 |
| 4,322,047 | 3/1982 | Bonnabaud | 242/128 |

*Primary Examiner*—Leonard D. Christian

*Attorney, Agent, or Firm*—H. Gibner Lehmann; K. Gibner Lehmann

[57] ABSTRACT

A cap assembly for facilitating pay-off of wire past one end flange of a spool, comprising a wheel carried on a shaft mounted along the axis of the spool at one end, and a tension brush comprising a body having radially extending, resilient and flexible tines extending to the periphery of the wheel, and adapted to be brushed by a wire strand as it orbits or traverses the spool end flange and passes over the wheel. The wheel is rotatable on the shaft, and the moving strand imparts turning motion thereto during pay-off. The tension brush body is also rotatable on the shaft under the action of the orbiting strand. An adjustable braking device is associated with the brush body and shaft such that a small drag force can be imparted to the brush as it is rotating, tending to slow it down to a point where the tines are moving at a circumferential velocity somewhat less than that of the strand. This has the desired effect of minimizing the tendency for the tines of the brush to move at the same speed as the strand, which would defeat the purpose of the brush. Also, the slight drag on the brush causes the strand to be swept by the tines at a relatively slow rate, thereby maintaining the desired brushing action but eliminating fast relative movement between the tines and strand, as in the case of a stationary brush. Higher pay-out speeds are thus attainable with the present arrangement than with any other known wheel/brush combinations, and significantly improved results are thereby had.

18 Claims, 3 Drawing Figures

CAP ASSEMBLY WITH FRICTION DRAG ON TENSION BRUSH

BACKGROUND

This invention relates generally to pay-off constructions for use with wire-filled spools, and more particularly to devices of this type which employ both a wheel and a brush having radially extending tines adjacent the periphery of the wheel in order to control the movement of the strand as it is being de-reeled.

In particular, the invention relates to improvements in the wire take-off mechanisms illustrated in U.S. Pat. No. 3,972,489 dated Aug. 3, 1976, issued to Joseph J. Kovaleski, and entitled TENSION BRUSH WITH ADJUSTABLE BRAKE, and U.S. Pat. No. 4,298,174 dated Nov. 3, 1981, issued to Joseph J. Kovaleski, and entitled WIRE TAKE-OFF DEVICE.

U.S. Pat. No. 3,972,489 shows a take-off mechanism which employs a rotatable wheel and a fixedly-mounted tension brush carried on a shaft disposed at one of the spool ends. The wheel was provided with an adjustable brake which slowed its speed somewhat with respect to the orbital velocity of a strand of wire that was being payed off. This had several beneficial effects. One was that the small drag provided by the brake tended to minimize the inertia effect of the wheel under circumstances where the wire speed was suddenly reduced. Without the brake the wheel tended to keep turning, causing additional turns of wire to be de-reeled even though the take up movement may have suddenly stopped, or the speed been abruptly cut. Additionally, with a freely rotating wheel, under certain circumstances there was a tendency for the strand to engage a single point on the wheel such that the latter would move in synchronism with the strand. When this occurred, the strand eventually gouged a notch or recess in the wheel. The effect quickly worsened after the initial gouge was formed, since the strand often lodged at this one point.

In addition, with larger wire sizes and reels, there occurred excessive brush wear, necessitating frequent replacement. Under certain conditions, the wire could "balloon" out, that is, leave the brush. Such an occurrence meant that the strand was completely out of contact with the brush, and the desired control effect of the brush was thus lost.

U.S. Pat. No. 4,298,174 shows an arrangement for de-reeling the wire from two filled spools in succession, where a single continuous length of wire carried over from one to the second. In this patented device, the spools were provided with freely rotating wheels which turned under the action of the moving strand, and in addition, motor-powered brush drivers were provided, for imparting a predetermined rotation to the tension brush assemblies. This arrangement operated well from the standpoint of reducing the relative speed between the strand and the brush. It was, however, somewhat complex in its operation, since there was associated with the motor drives, control circuitry which was needed to sense wire speed and adjust brush speed accordingly in order to produce the desired relative movement between the brushes and the strands.

SUMMARY

The above disadvantages and drawbacks of prior pay-off arrangements are largely obviated by the present invention which has for an object to provide a novel and improved cap assembly for facilitating pay-off of wire past one end flange of a spool, the assembly being both simple in construction and reliable in operation, and constituting an effective means for controlling the tension in the strand being de-reeled over a wide range of operating conditions.

A related object of the invention is to provide an improved cap assembly as above set forth, wherein the tendency for the strand to experience excessive looseness is greatly minimized, such that the operator has a good degree of control over the de-reeling procedure.

Still another object of the invention is to provide an improved cap assembly as above characterized, wherein no special equipment is required to sense wire speed, and wherein no electrical apparatus is needed, involving either costly automatic controls or skilled personnel for their proper operation.

Yet another object of the invention is to provide an improved cap assembly of the kind indicated, which greatly minimizes the likelihood of the strand leaving the brush altogether at high pay-off speeds, this effect being known as "ballooning"; and to provide an assembly which reduces considerably the wear experienced by the radial tines associated with the brush.

Still another object of the invention is to provide an improved cap assembly as outlined above, wherein the likelihood of inadvertent breakage of the strand is reduced, and wherein the de-reeling operation is both smooth and efficient, even at high pay-off speeds.

The above objects are accomplished by a cap assembly for facilitating pay-off of wire past one end flange of a spool, comprising a shaft carried at one end of the spool, a wheel having a peripheral portion extending adjacent the periphery of the one spool end flange, and a tension brush assembly having a hub rotatable on the shaft and a body with a plurality of radially extending, flexible and resilient tines adjacent the periphery of the wheel. The wheel is intended to be rotated as it is engaged by the unwinding strand, as is the tension brush assembly. The brush assembly has an adjustable brake which applies a small drag force to it, sufficient to reduce the circumferential velocity of the tines thereof to a value somewhat less than that of the strand as it passes over or orbits the spool flange and wheel. The arrangement is such that the relative speed of the strand optimally just exceeds that of the tines whereby the latter are brushed by the strand at a relatively slow speed, so as to minimize wear to the tines and at the same time reduce the likelihood of the strand being subjected to excessive force, which might result in its being severed. In addition, higher take-off speeds can be tolerated with the present arrangement, compared to that where a rotatable wheel and stationary brush were employed, since in the latter case, the velocity of the unwinding strand was often sufficient to cause it to "balloon" out of engagement with the brush entirely. With the brush periphery moving at just under the orbital velocity of the strand about the spool flange, there is maintained excellent control of the tension in the strand, and the tendency for "ballooning" to occur is greatly diminished.

Other features and advantages will hereinafter appear.

In the drawings, illustrating a preferred embodiment of the invention:

Figure 1:
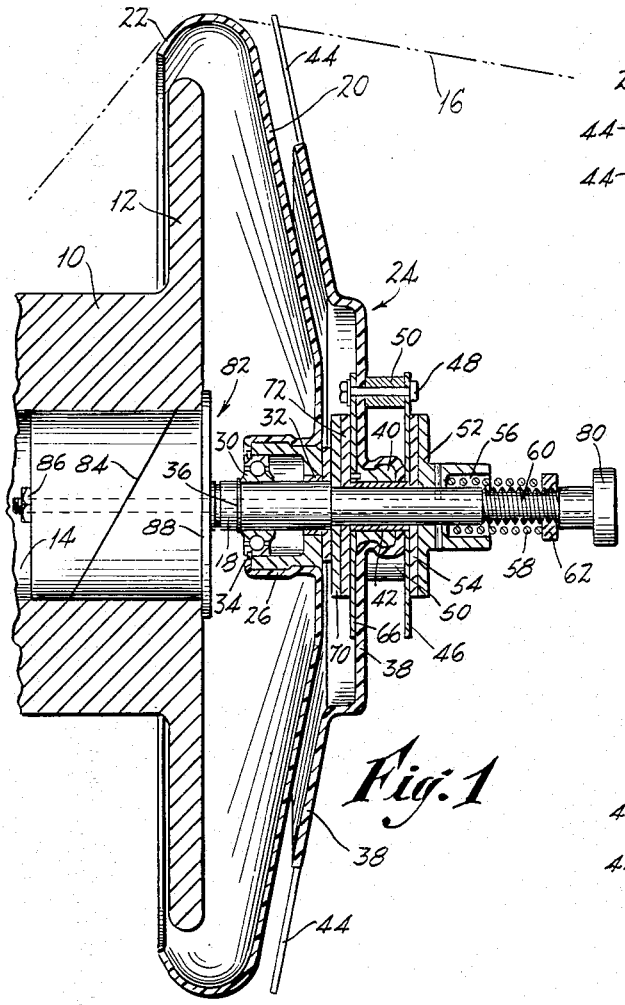
FIG. 1 is a fragmentary vertical section of a spool having the improved pay-off cap assembly of the invention in position, and illustrating a shaft and the rotatable wheel and tension brush assembly associated therewith.

Referring first to FIG. 1 there is illustrated, in fragmentary section, a wire carrying spool 10 having an end flange 12 and an axial bore 14. A strand 16 of wire is shown, in dotted outline, extending from the spool and past the periphery of the flange 12, toward a take-up location (not illustrated).

In accordance with the present invention there is provided a novel and improved cap assembly for facilitating pay-off of wire past the end flange 12, the assembly comprising a shaft 18, a rotatable wheel 20 having a curved peripheral portion 22 extending over the flange 12 and adapted to be engaged by the strand 16 as the latter orbits, and a tension brush assembly generally designated 24. The brush assembly is rotatable on the shaft 18, and has a unique braking system which imparts an adjustable drag force to the brush assembly as the latter is rotating, also under the influence of the strand 16, the braking system enabling greatly improved control over the tension in the strand under conditions of high speed pay-off, and additionally functioning to minimize excessive wear of bristles or tines that are associated with the brush.

Figure 3:
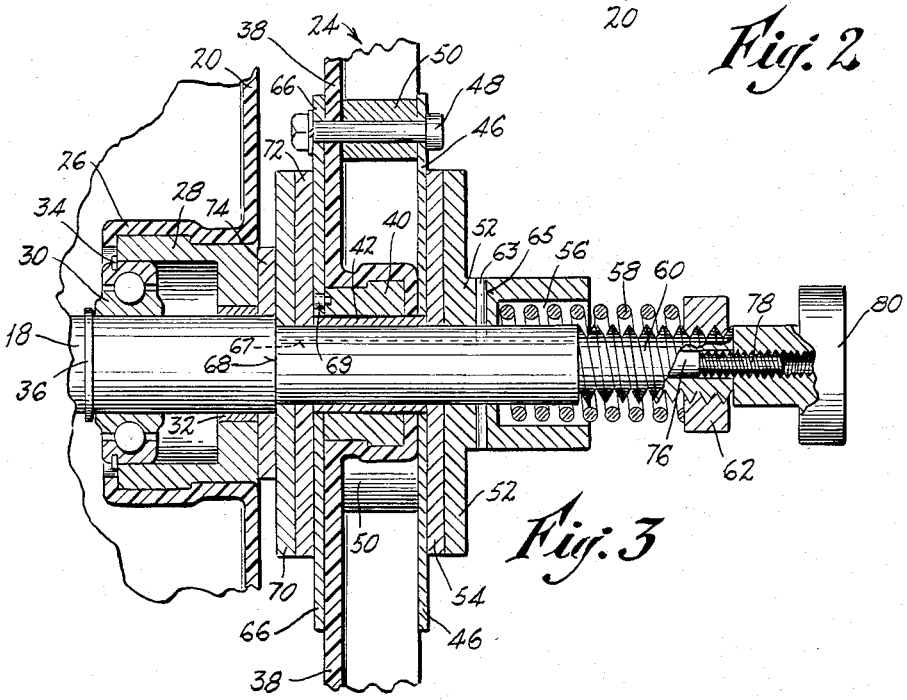
FIG. 3 is an enlarged fragmentary view of the central portions of the wheel and brush assembly, particularly showing details of the mounting arrangement on the shaft.

Referring to FIGS. 1 and 3, the wheel 20 has a body that is constituted preferably of plastic, and a central tubular portion 26 that is molded over an aluminum hub 28 in such a manner that the latter is held captive, as best shown in FIG. 3. Pressed into the aluminum hub 28 is a ball bearing 30 which may be of conventional construction, and a bronze sleeve bearing 32. The bearings 30 and 32 are carried on the shaft 18 as shown. Positioning of the bearing 30 is accomplished by a split ring 34 that engages the end of the hub 28; in addition, the inner race of the bearing 30 engages another split ring 36 that is received in a groove in the shaft 18 and constitutes an annular shoulder thereon.

Referring again to FIGS. 1 and 3, the tension brush assembly 24 comprises a generally circular body 38 which, again, is preferably constituted of molded plastic, formed around a steel hub 40. A bronze bearing 42 is disposed between the hub 40 and the shaft 18. At the periphery of the body 38 is a plurality of flexible and resilient, radially disposed tines of nylon or other suitable material, designated 44, the tines extending adjacent to the periphery 22 of the wheel, and the ends of which are intended to be brushed by the strand 16 as the latter orbits the flange 12 and engages the wheel periphery 22.

Figure 2:
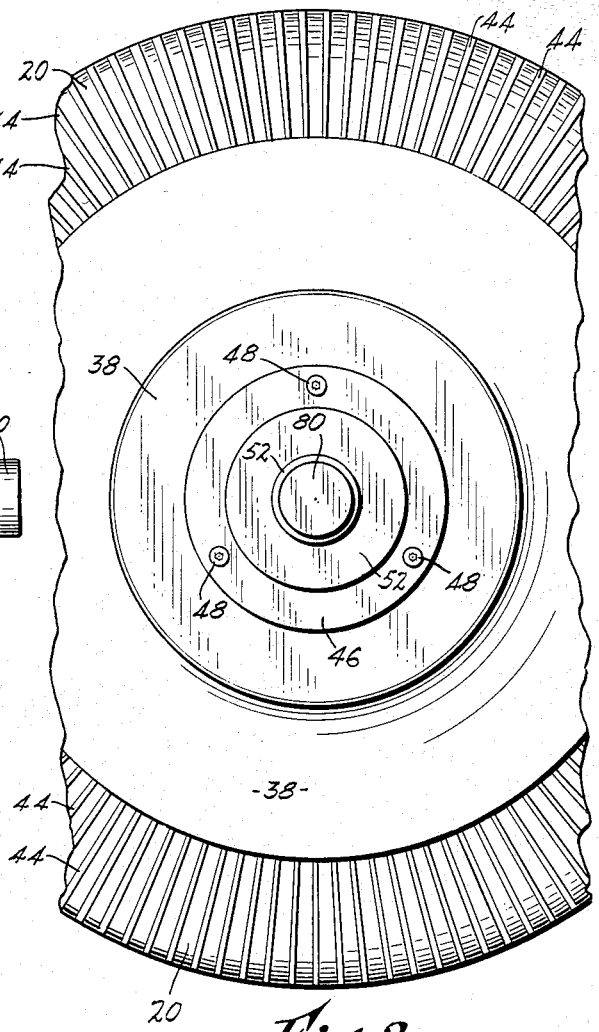
FIG. 2 is a right end elevation of the pay-off cap assembly of FIG. 1.

The braking arrangement for the tension brush assembly 24 comprises a brake facing 46 preferably constituted of metal and being of generally circular configuration, secured to the body 38 by means of bolts 48, shown in FIG. 2 as being three in number. Spacers 50 are disposed between the facing 46 and the body 38. Slidable on the shaft 18 is a brake shoe or support 52. Disposed between the shoe 52 and the facing 46 is a floating lining 54, preferably felt or other suitable lining material. The lining 54 is not cemented or otherwise connected to either the shoe 52 or the facing 46.

The shoe 52 has a cup-like configuration, forming a recess 56 that constitutes a seat for one end of a spring 58 that surrounds the shaft, as shown. A portion 60 of the shaft 18 is threaded, and carries a nut 62 against which the other end of the spring bears. Adjustment of the position of the nut 62 increases or decreases the force applied by the spring against the shoe 52, and accordingly varies the degree of compression of the lining 54. The shoe 52 is retained against rotation with respect to the shaft 18 by a roll pin 63 received in a radial hole 65, and extending into a longitudinal groove 67 in the shaft. The pin and groove thus constitute a spline connection between the shoe and shaft to permit axial movement of the shoe 52.

The body 38 may also optionally be provided with a second brake facing or plate 66 on its opposite side. This plate is preferably secured by the same bolts 48 employed to hold the first facing 46. A key 69 can optionally be provided, to positively affix the facing 66 to the hub 40 and body 38. The shaft 18 has a shoulder 68 against which a support in the form of a washer 70 bears, with a floating lining 72 similar to the lining 54 interposed between the washer 70 and the facing 66 and not otherwise cemented or connected to either part. In the present arrangement, the bearing 42 is slidable axially on the shaft 18, such that as pressure is applied by the shoe 52 against the facing 46 as permitted by the pin 63 sliding along the shaft groove 67, the body 38 can shift axially toward the left in FIG. 3 and cause the facing 66 to more firmly engage the washer 70 through the lining 72. The body 38 is thus sandwiched between the facings 46 and 66, and their corresponding shoes 52, 70 and linings 54, 72, respectively. The washer 70 is stationary with respect to the shaft 18, as by being pressed in place, or by means of a weld (not illustrated).

Also, by the present invention, in addition to the adjustable braking feature provided on the tension brush assembly 24, a limited, fixed brake is provided for the wheel 20. This comprises the left face of the washer 70 in FIG. 3, against which there is disposed a lining 74 which may be similar in construction to those associated with the brush assembly. The opposite face of the lining 74 bears, with generally constant pressure, against the metal hub 28 of the wheel, thereby applying a small, constant drag force thereto. The fixed brake prevents free turning of the wheel, which might be undesirable under certain circumstances, as where the take-up mechanism (not shown) was suddenly shut down, or where the take-up speed was abruptly reduced. In other, prior installations where the wheel 38 was completely free, its inertia tended to maintain it in motion even after the strand 16 had stopped, causing a tendency for additional coils of wire to unravel from the spool and leading to excessive looseness, possible kinking, etc.

Referring again to FIG. 3, the shaft 18 is hollow, with a second, smaller diameter shaft 76 extending therethrough. The outer end of the shaft 76 is threaded at 78 and carries a manually engageable member 80 having a bore that is internally threaded. The end face of the member 80 bears against the end of the threaded portion 60 of the shaft. The shaft 76 extends completely through the outer shaft 18, and through an opening (FIG. 1) in the end of a large tubular two-part hub 82 which is adapted to be received in the bore 14 of the spool. The hub 82 is split along a plane 84 that is oblique to the axis of the hub. The shaft 78 carries a nut 86 which bears against a transverse or end face of the hub 82 as shown. The hub also has an annular flange 88 constituting a positioning shoulder which bears against the end surface of the spool flange 12. With such an arrangement, tightening of the member 80 on the shaft 78 causes axial shifting of the shaft 76 to the right in FIG. 3, which in turn causes the two portions of the hub 82 to slide with respect to one another along the plane 84. The leftmost hub portion is driven upwardly into firm engagement with the upper cylindrical surface of the spool bore 14, and the rightmost hub portion is similarly driven downwardly into engagement with the lower cylindrical surface thereof. The effective diameter of the hub 82 is thus increased. By such an arrangement, both the wheel 20 and brush assembly 24 can be quickly and easily releasably carried at the end of the spool, all without the need for special mounting fixtures or jigs.

In operation, during start up, the strand 16 is pulled over the periphery 22 of the wheel, past the tines 44 and thereafter extends to a take-up mechanism (not shown) as would be required if the wire were to be either transferred to a different spool, or subjected to coating or subsequent finishing processes, or alternately fed into a buncher or stranding apparatus, for example. As the wire is payed out, its engagement with the wheel 20 causes it to begin turning, the same being true of the brush assembly 24. The brake mechanism comprising the shoes 52 and 70, facings 46 and 66, and linings 54 and 72, limits the circumferential velocity of the tines to a value somewhat less than that of the strand 16 as it is orbiting or traversing the periphery of the spool flange, in engagement with the wheel 20. Similarly, the brake for the wheel effects a slight drag force to insure that the wheel cannot spin in exact synchronism with the strand and possibly cause "gouging" at a point on the wheel. At high pay-off speeds, the velocity of the wheel periphery will lag that of the strand by a slight amount; similarly, the nut 62 can be adjusted to vary the drag imparted to the brush assembly such that the velocity of the tines is somewhat less than that of the strand. By this arrangement, there will occur a slow relative movement of the tines with respect to the strand, which is the most desired operating condition. This results in good control of the tension in the strand, minimizing looseness and preventing problems of possible kinking, etc.; in addition the likelihood of the strand "ballooning", that is, completely losing contact with the tines, is minimized. The arrangement is in sharp contrast with prior devices wherein a stationary brush was employed. In such installations, the velocity of the strand relative to the stationary tines was sufficiently great that the tines often lost control over the strand, and the latter would merely whip freely around the wheel 20 and brush 24. The present construction effectively overcomes this undesired loss of control.

From the above it can be seen that I have provided a novel and improved cap assembly which is both simple in its structure and operation, and which is completely self contained, requiring no special fixtures or electrical control or speed sensing equipment. The parts are fabricated from readily available components, or formed in simple mold cavities. The device is thus seen to represent a distinct advance and improvement in the field of wire transfer equipment.

Each and every one of the appended claims defines an aspect of the invention which is separate and distinct from all others, and accordingly each claim is to be treated in this manner when examined in the light of the prior art devices in any determination of novelty or validity.

Variations and modifications are possible without departing from the spirit of the invention.

What is claimed is:

1. A cap assembly for facilitating pay-off of wire past one end flange of a spool, comprising in combination:

(a) a shaft, (b) means mounting the shaft at one of the spool ends, (c) a non-powered turnable wheel on the shaft, said wheel having a peripheral portion extending adjacent the periphery of the said one end flange of the spool, (d) a bearing mounting the wheel for free rotation with respect to the shaft, to enable wire being payed off the said one spool end flange to engage the wheel and impart rotation thereto, (e) a tension brush assembly comprising a hub rotatable on said shaft and a brush body carried by the hub, said brush body having a plurality of radially extending, flexible and resilient tines disposed adjacent the periphery of the wheel, said tines being adapted to be brushed by the strand of wire as it passes over the wheel periphery, (f) means mounting the brush assembly at the said one end flange of the spool, for rotation under the influence of the strand brushing past the tines, and (g) means for imparting an adjustable braking force to the brush assembly so as to slow its rotation whereby the circumferential velocity of the tines can be adjusted to a value less than the orbital speed of the strand of wire past the periphery of the spool flange.

2. The invention as set forth in claim 1, wherein:

(a) said tension brush body is of generally circular configuration, (b) said force imparting means comprising a metal brake facing at one side of the body, fixed with respect thereto and adapted to rotate therewith, (c) a brake shoe carried by the shaft, and (d) adjustment means on said shaft and brake shoe, to enable either greater or lesser force to be applied by said shoe to the brake facing.

3. The invention as set forth in claim 2, wherein:

(a) said adjustment means comprises a threaded portion on said shaft, (b) a nut disposed on the threaded portion, and (c) spring means disposed between said nut and brake shoe and arranged to apply an axial force to the latter so as to bias it toward the facing and to impart a drag thereto.

4. A cap assembly for facilitating pay-off of wire past one end flange of a spool, comprising in combination:

(a) a shaft, (b) means mounting the shaft at one of the spool ends, (c) a wheel having a peripheral portion extending adjacent the periphery of the said one end flange of the spool, (d) a bearing mounting the wheel for rotation with respect to the shaft, to enable wire being payed off the said one spool end flange to engage the wheel and impart rotation thereto, (e) a tension brush assembly comprising a hub rotatable on said shaft and a body, said body having a plurality of radially extending, flexible and resilient tines disposed adjacent the periphery of the wheel, said tines being adapted to be brushed by the strand as it passes over the wheel periphery, (f) means mounting the brush assembly at the said one end flange of the spool, for rotation under the influence of the strand brushing past the tines, (g) means for imparting an adjustable braking force to the brush assembly, so as to slow its rotation, whereby the circumferential velocity of the tines can be adjusted to a value less than the orbital speed of the strand past the periphery of the spool flange, (h) said tension brush body being of generally circular configuration, (i) said force imparting means comprising a metal brake facing at one side of the body, fixed with respect thereto and adapted to rotate therewith, (j) a brake shoe carried by the shaft, (k) adjustment means on said shaft and brake shoe, to enable either greater or lesser force to be applied by said shoe to the brake facing, (l) said adjustment means comprising a threaded portion on said shaft, (m) a nut disposed on the threaded portion, and (n) spring means disposed between said nut and brake shoe and arranged to apply an axial force to the latter so as to bias it toward the facing and to impart a drag thereto, (o) said brake shoe comprising a cup-like configuration, constituting a seat for one end of the spring means.

5. The invention as set forth in claim 2, and further including:

(a) means defining a spline connection between the brake shoe and the shaft, so as to enable the shoe to move axially thereon but without rotation with respect thereto.

6. The invention as set forth in claim 5, wherein:

(a) said spline comprises means defining a longitudinal groove in said shaft, and (b) a pin carried by said shoe and extending into the groove.

7. The invention as set forth in claim 6, wherein:

(a) said pin comprises a roll pin.

8. A cap assembly for facilitating pay-off of wire past one end flange of a spool, comprising in combination:

(a) a shaft, (b) means mounting the shaft at one of the spool ends, (c) a wheel having a peripheral portion extending adjacent the periphery of the said one end flange of the spool, (d) a bearing mounting the wheel for rotation with respect to the shaft, to enable wire being payed off the said one spool end flange to engage the wheel and impart rotation thereto, (e) a tension brush assembly comprising a hub rotatable on said shaft and a body, said body having a plurality of radially extending, flexible and resilient tines disposed adjacent the periphery of the wheel, said tines being adapted to be brushed by the strand as it passes over the wheel periphery, (f) means mounting the brush assembly at the said one end flange of the spool, for rotation under the influence of the strand brushing past the tines, (g) means for imparting an adjustable braking force to the brush assembly, so as to slow its rotation, whereby the circumferential velocity of the tines can be adjusted to a value less than the orbital speed of the strand past the periphery of the spool flange, (h) said tension brush body being of generally circular configuration, (i) said force imparting means comprising a metal brake facing at one side of the body, fixed with respect thereto and adapted to rotate therewith, (j) a brake shoe carried by the shaft, (k) adjustment means on said shaft and brake shoe, to enable either greater or lesser force to be applied by said shoe to the brake facing, (l) said force imparting means comprising a second metal brake facing at the opposite one of the sides of the tension brush body, and (m) an additional brake shoe carried by the shaft and adjacent the second metal facing, (n) said tension brush hub being disposed between the first mentioned brake facing and its shoe and the second brake facing and its shoe.

9. A cap assembly for facilitating pay-off of wire past one end flange of a spool, comprising in combination:

(a) a shaft, (b) means mounting the shaft at one of the spool ends, (c) a wheel having a peripheral portion extending adjacent the periphery of the said one end flange of the spool, (d) a bearing mounting the wheel for rotation with respect to the shaft, to enable wire being payed off the said one spool end flange to engage the wheel and impart rotation thereto, (e) a tension brush assembly comprising a hub rotatable on said shaft and a body, said body having a plurality of radially extending, flexible and resilient tines disposed adjacent the periphery of the wheel, said tines being adapted to be brushed by the strand as it passes over the wheel periphery, (f) means mounting the brush assembly at the said one end flange of the spool, for rotation under the influence of the strand brushing past the tines, (g) means for imparting an adjustable braking force to the brush assembly, so as to slow its rotation, whereby the circumferential velocity of the tines can be adjusted to a value less than the orbital speed of the strand past the periphery of the spool flange, (h) said tension brush body being of generally circular configuration, (i) said force imparting means comprising a metal brake facing at one side of the body, fixed with respect thereto and adapted to rotate therewith, (j) a brake shoe carried by the shaft, (k) adjustment means on said shaft and brake shoe, to enable either greater or lesser force to be applied by said shoe to the brake facing, (l) said brake shoe comprising a metal support, and (m) a layer of felt material on said support and disposed between the latter and the brake facing of the tension brush body.

10. The invention as set forth in claim 8, wherein:

(a) said mounting means for the brush assembly comprises a slide bearing capable of axial movement with respect to the shaft, (b) the body of the brush assembly and facings carried thereby being shiftable axially of the shaft so as to enable balancing of the force applied by the one shoe to its facing against the force applied by the other shoe to its facing.

11. The invention as set forth in claim 8, wherein:

(a) the shaft has an annular shoulder, (b) the additional brake shoe comprising a washer disposed against said shoulder and held stationary with respect thereto.

12. The invention as set forth in claim 1, and further including:

(a) means removably mounting the shaft to the spool.

13. A cap assembly for facilitating pay-off of wire past one end flange of a spool, comprising in combination:

(a) a shaft, (b) means mounting the shaft at one of the spool ends, (c) a wheel having a peripheral portion extending adjacent the periphery of the said one end flange of the spool, (d) a bearing mounting the wheel for rotation with respect to the shaft, to enable wire being payed off the said one spool end flange to engage the wheel and impart rotation thereto, (e) a tension brush assembly comprising a hub rotatable on said shaft and a body, said body having a plurality of radially extending, flexible and resilient tines disposed adjacent the periphery of the wheel, said tines being adapted to be brushed by the strand as it passes over the wheel periphery, (f) means mounting the brush assembly at the said one end flange of the spool, for rotation under the influence of the strand brushing past the tines, (g) means for imparting an adjustable braking force to the brush assembly, so as to slow its rotation, whereby the circumferential velocity of the tines can be adjusted to a value less than the orbital speed of the strand past the periphery of the spool flange, (h) means removably mounting the shaft to the spool, (i) said mounting means comprising a tubular hub adapted to be inserted into the bore of the spool, (j) said tubular hub being split along a plane which is oblique with respect to its axis, (k) means for drawing the opposite ends of the tubular hub toward one another so as to expand the effective diameter of the tubular hub and bring the split portions into firm engagement with opposite cylindrical surfaces respectively of the bore of the spool.

14. The invention as set forth in claim 13, and further including:

(a) a manual adjustment connected with said tubular hub and extending through said shaft, for effecting said drawing of the ends of the tubular hub toward one another.

15. The invention as set forth in claim 1, and further including:

(a) means on the shaft and engageable with the wheel, for imparting a fixed drag force to the latter, in order to minimize and tendency for the wheel to continue turning freely in the event that the wire speed is reduced or the wire suddenly halted.

16. The invention as set forth in claim 1, and further including:

(a) means on the shaft and engageable with the wheel, for imparting a fixed drag force to the latter in order to reduce the operating speed of the wheel and cause the speed of its periphery to slightly lag the orbital velocity of the strand about the periphery of the spool flange during pay-out.

17. In a cap assembly for facilitating pay-off of wire past one end flange of a spool, said assembly being of the type having a shaft capable of being mounted at one of the spool ends, having a rotatable wheel comprising a peripheral portion extending adjacent the periphery of the said one end flange, having a tension brush assembly including a rotatable brush body having radially extending, flexible and resilient tines disposed adjacent the periphery of the wheel, and having means mounting the brush assembly at the said one end flange, the method of paying wire off the end of the spool, comprising the steps of:

(a) drawing a strand of wire from the spool, over the peripheral portion of the wheel so as to impart rotation thereto by virtue of its frictional engagement therewith, (b) thereafter drawing the said strand past the tines of the brush assembly so as to impart rotation to the brush assembly by virtue of the strand brushing past the tines thereof, and (c) imparting a manually adjustable braking force to the brush assembly so as to slow its rotation and reduce the tangential velocity of the tines to a value that is less than that of the orbital speed of the strand of wire past the periphery of the spool flange, whereby there is established a relatively small tangential speed differential between the tines of the brush assembly and the strand of wire so as to minimize any tendency for the strand to experience excessive drag force and break due to its engagement with the tines.

18. The method of claim 17, wherein:

(a) the rotation of the brush assembly is slowed to a value which is less than that of the rotation of the wheel.

* * * * *